US010940981B2

(12) United States Patent
French et al.

(10) Patent No.: US 10,940,981 B2
(45) Date of Patent: Mar. 9, 2021

(54) PACKAGE WITH LOCKABLE LID

(71) Applicant: Berry Global, Inc., Evansville, IN (US)

(72) Inventors: Jordan Robert French, Evansville, IN (US); Seth Tempel, Evansville, IN (US)

(73) Assignee: Berry Global, Inc., Evansville, IN (US)

( * ) Notice: Subject to any disclaimer, the term of this patent is extended or adjusted under 35 U.S.C. 154(b) by 9 days.

(21) Appl. No.: 16/295,197

(22) Filed: Mar. 7, 2019

(65) Prior Publication Data

US 2019/0276181 A1 Sep. 12, 2019

Related U.S. Application Data

(60) Provisional application No. 62/639,595, filed on Mar. 7, 2018.

(51) Int. Cl.

| | |
|---|---|
| ***B65D 43/16*** | (2006.01) |
| ***B65D 77/04*** | (2006.01) |
| ***B65D 5/66*** | (2006.01) |
| ***B65D 43/02*** | (2006.01) |
| ***B65D 8/00*** | (2006.01) |

(52) U.S. Cl.

CPC ..... *B65D 43/161* (2013.01); *B65D 5/6632* (2013.01); *B65D 11/02* (2013.01); *B65D 43/0225* (2013.01); *B65D 43/0235* (2013.01); *B65D 77/046* (2013.01); *B65D 2251/02* (2013.01); *B65D 2251/04* (2013.01); *B65D 2251/1016* (2013.01); *B65D 2251/20* (2013.01); *B65D 2543/00092* (2013.01)

(58) Field of Classification Search

CPC ..... B65D 21/0209; B65D 21/0233; B65D 41/06; B65D 41/04; B65D 43/161; B65D 43/16; B65D 43/0225; B65D 43/0235; B65D 5/6632; B65D 5/6629; B65D 77/046; B65D 51/24; A45D 33/003; A45D 33/006; A45C 5/005

USPC ..... 220/293, 288, 212, 4.27, 4.26; 215/332, 215/329, 228; 206/581, 518, 515; 132/293

See application file for complete search history.

(56) References Cited

U.S. PATENT DOCUMENTS

| | | | | |
|---|---|---|---|---|
| 1,464,552 A * | 8/1923 | Warner | A45D 33/32 362/137 |
| 2,521,278 A * | 9/1950 | Bauman | A45D 33/003 220/8 |
| 5,449,078 A | 9/1995 | Akers | |
| 5,908,125 A | 6/1999 | Opresco | |
| 5,927,528 A * | 7/1999 | Jones | B65D 41/06 116/309 |
| 6,076,689 A | 6/2000 | Vassallo | |

(Continued)

FOREIGN PATENT DOCUMENTS

GB 2512630 A * 10/2014 ..... A45D 33/006

OTHER PUBLICATIONS

Non Final Office Action of U.S. Appl. No. 16/295,202 dated May 28, 2020, all enclosed pages cited.

*Primary Examiner* — Robert J Hicks

(57) ABSTRACT

A package having a tray and a lockable lid is disclosed herein. The lid may be removed by applying a user input so that, for example, the package is child resistant. The lid is movable between a closed position and an open position. The package may include grinders to grind contents in the package.

17 Claims, 11 Drawing Sheets

(56) References Cited

U.S. PATENT DOCUMENTS

| | | | | |
|---|---|---|---|---|
| 6,378,533 | B1 * | 4/2002 | Roman | A45D 33/006 132/295 |
| 6,439,409 | B1 | 8/2002 | Dressel et al. | |
| 6,679,381 | B1 | 1/2004 | Bush | |
| 7,549,541 | B2 | 6/2009 | Brozell et al. | |
| 8,066,122 | B2 | 11/2011 | Beecroft et al. | |
| 8,220,636 | B2 | 7/2012 | Beecroft et al. | |
| 8,292,110 | B2 | 10/2012 | Rutter et al. | |
| 8,839,803 | B2 * | 9/2014 | Holloway | A45D 33/02 132/298 |
| 9,694,955 | B2 | 7/2017 | Wu et al. | |
| 9,878,821 | B2 | 1/2018 | Sibley | |
| 9,895,698 | B2 | 2/2018 | Spielman | |
| 2010/0025355 | A1 | 2/2010 | Beecroft | |
| 2016/0039591 | A1 | 2/2016 | Kinzer | |
| 2016/0090213 | A1 | 3/2016 | Murray | |
| 2017/0007004 | A1 * | 1/2017 | Burditt, Jr. | A45D 33/008 |
| 2017/0027168 | A1 | 2/2017 | Heath | |
| 2017/0112181 | A1 | 4/2017 | Belfance et al. | |
| 2017/0113841 | A1 | 4/2017 | Murray | |
| 2017/0319009 | A1 | 11/2017 | Seckel et al. | |
| 2017/0349338 | A1 | 12/2017 | Ziering et al. | |
| 2018/0042890 | A1 | 2/2018 | Sinai et al. | |
| 2018/0177277 | A1 * | 6/2018 | Dinata | A45D 33/006 |
| 2018/0199693 | A1 * | 7/2018 | Chung | A45D 40/221 |
| 2019/0315526 | A1 * | 10/2019 | Gomez Cao | B65D 45/325 |

* cited by examiner

PACKAGE WITH LOCKABLE LID

PRIORITY CLAIM

This application claims priority under 35 U.S.C. § 119(e) to U.S. Provisional Application Ser. No. 62/639,595, filed Mar. 7, 2018, which is expressly incorporated by reference herein.

TECHNICAL FIELD

The present disclosure relates generally to a container, and more specifically to a container for storing perishables that has features for resisting undesired opening.

BACKGROUND

It is often desirable to provide a container for storing items, which may include perishable items, that also has features that make opening it child resistant.

SUMMARY

Certain embodiments according to the present disclosure provide a package with one or more selectively openable and/or closeable lid portions.

In one aspect, for instance, a package is provided having a container, a tray, and a lid. The tray is removably attachable to the container to define a first product storage region and the lid is removably attachable to the tray to form a second product storage region. The tray is movable by a user input between an open container position in which the tray is at least partially removed from the container and a closed container position in which the tray is blocking access to the first product storage region. The tray is lockably attachable to the container in a locked position to prevent rotation of the tray relative to the container in at least one rotational direction, and wherein the tray is selectively movable by a user input in an axial direction transverse to the at least one rotation direction between the locked position and a released position. The tray is free to rotate in the at least one rotational direction in the released position. The lid is movable relative to the tray between a closed lid position in which the lid substantially blocks access to the second product storage region and an open lid position in which the second product storage region is accessible by a user.

In another aspect, a package is provided that includes a container, a tray, and a lid. The tray is removably attachable to the container to define a first product storage region and the lid is removably attachable to the tray to form a second product storage region. The tray is movable by a user input between an open container position in which the tray is at least partially removed from the container and a closed container position in which the tray is blocking access to the first product storage region. The tray is lockably attachable to the container in a locked position to prevent rotation of the tray relative to the container in at least one rotational direction, and wherein the tray is selectively movable by a user input in an axial direction transverse to the at least one rotation direction between the locked position and a released position. The tray is free to rotate in the at least one rotational direction in the released position. The lid is movable relative to the tray between a closed lid position in which the lid substantially blocks access to the second product storage region and an open lid position in which the second product storage region is accessible by a user. The lid includes a plurality of downwardly projecting upper grinders and the tray includes a plurality of upwardly projecting lower grinders, wherein the upper grinders and lower grinders are arranged to pass without contact when the lid is rotated relative to the tray when the lid and tray are in the closed lid position.

In yet another aspect, a package is provided having a container and a lid. The lid is removably attachable to the container to form a product storage region. The lid is movable by a user input between an open container position in which the lid is at least partially removed from the container and a closed container position in which the lid is blocking access to the product storage region. The lid is lockably attachable to the container in a locked position to prevent rotation of the lid relative to the container in at least one rotational direction, and wherein the lid is selectively movable by a user input in an axial direction transverse to the at least one rotation direction between the locked position and a released position. The lid is free to rotate in the at least one rotational direction in the released position. The lid and container have a substantially uniform and equal outer perimeter and a substantially uniform height around the outer perimeter circumference. The lid is lockably attachable to the container by one or more closure mechanisms that each include a lid projection and a cooperating container projection. The lid is lockably attachable to the container by one or more closure mechanisms that each include a lid projection and a cooperating container projection. The bayonet is coupled to the container. The cooperating lug is coupled to the lid. The bayonet includes a leading tip having an angled surface oppositely disposed a blunt surface, wherein the angled surface allows rotation of the cooperating lug into the bayonet and the blunt surface inhibits rotation of the cooperating lug out of the bayonet in the locked position. The container includes an upper side wall configured to form an angled interface with a lower side wall of the lid, and wherein the angled interface biases the lid away from the container in a first direction. The bias of the angled interface of the container upper side wall and the lid lower side wall may be overcome by a user push input, wherein the user push input may move the lid lower side wall relative to the container upper side wall from the locked position to the released position in which the cooperating lug may be rotated out of the bayonet.

BRIEF DESCRIPTION OF THE DRAWINGS

Embodiments now will be described more fully hereinafter with reference to the accompanying drawings, in which some, but not all embodiments may be shown. Indeed, embodiments may be illustrated or described in many different forms and the present disclosure should not be construed as limited to the embodiments set forth herein. Like numbers refer to like elements throughout, and wherein.

DETAILED DESCRIPTION

Embodiments now will be described more fully hereinafter with reference to the accompanying drawings, in which some, but not all embodiments may be shown. Indeed, embodiments may take many different forms and the present disclosure should not be construed as limited to the embodiments set forth herein. As used in the specification, and in the appended claims, the singular forms "a", "an", "the", include plural referents unless the context clearly dictates otherwise.

The terms "substantial" or "substantially" may encompass the whole as specified, according to certain embodiments, or largely but not the whole specified according to other embodiments.

Figure 1:
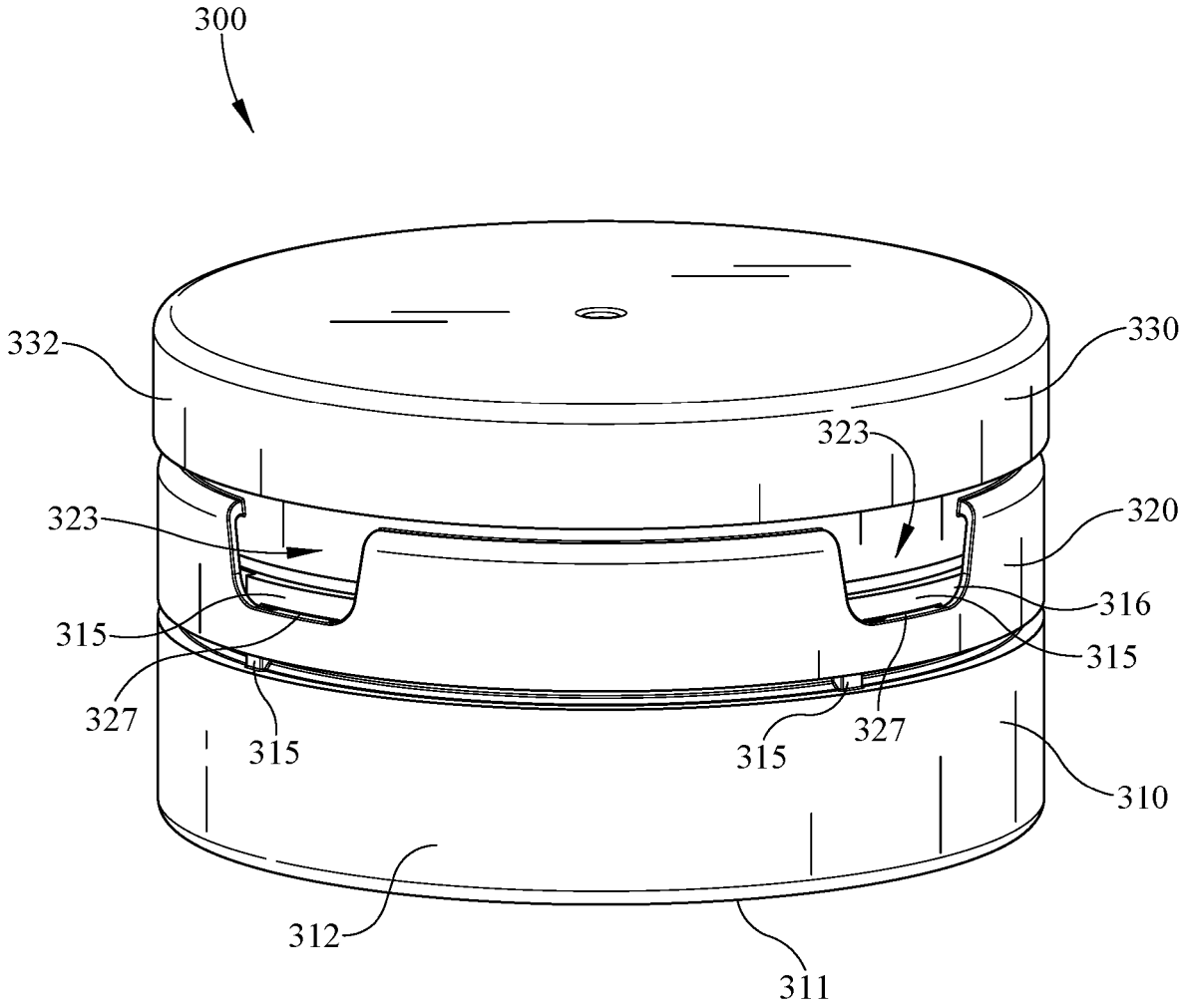
FIG. 1 illustrates a perspective view of an embodiment of a package in a closed position.

Some embodiments of a package 300 may include a container 310, a tray 320, and/or a lid 330, such as shown in FIG. 1 in an example of package 300 in a closed position. Container 310 may define an internal container storage region therein, which may be underneath tray 320 when in the closed position. Tray 320 may define an internal tray region therein, which may be underneath lid 330 when in the closed position. Lid 330 may be selectively and/or removably attached and/or coupled to tray 320. Tray 320 may be selectively and/or removably attached and/or coupled to container 310.

Figure 2:
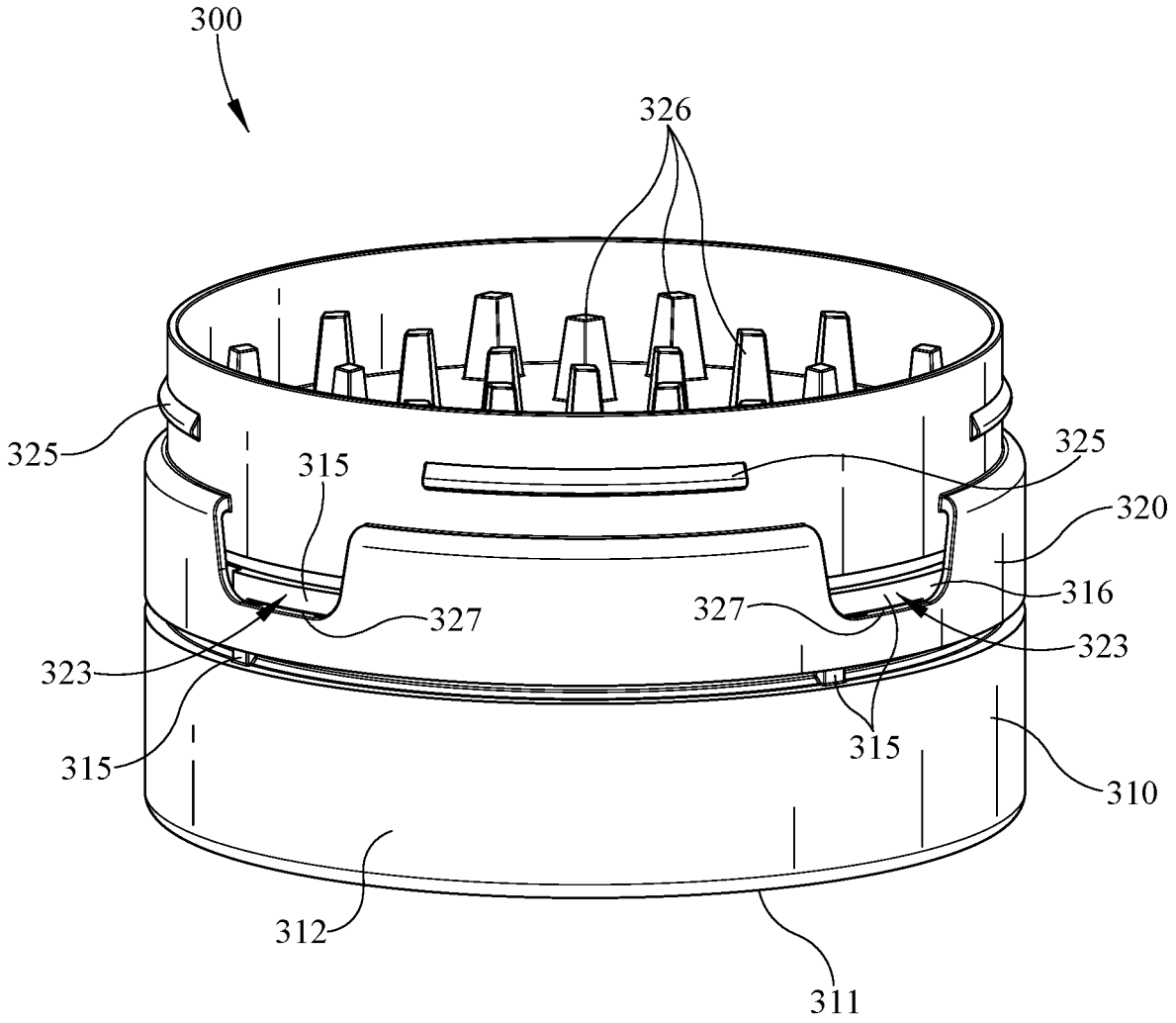
FIG. 2 illustrates a perspective view of the package of FIG. 1 in a closed position, without a lid.

Package 300 as shown in FIG. 2 may include one or more lower grinders 326. Lower grinders 326 may be coupled to and/or integral with, or any combination thereof, tray 320. Lower grinders 326 may be included for any of a variety of reasons including but not limited to grinding an item, substance, or contents. Tray 320 may include openings 323 for any of a variety of reasons, including but not limited to allowing a user to access and grasp the underside of lid 330 to remove it from tray 320.

Figure 3:
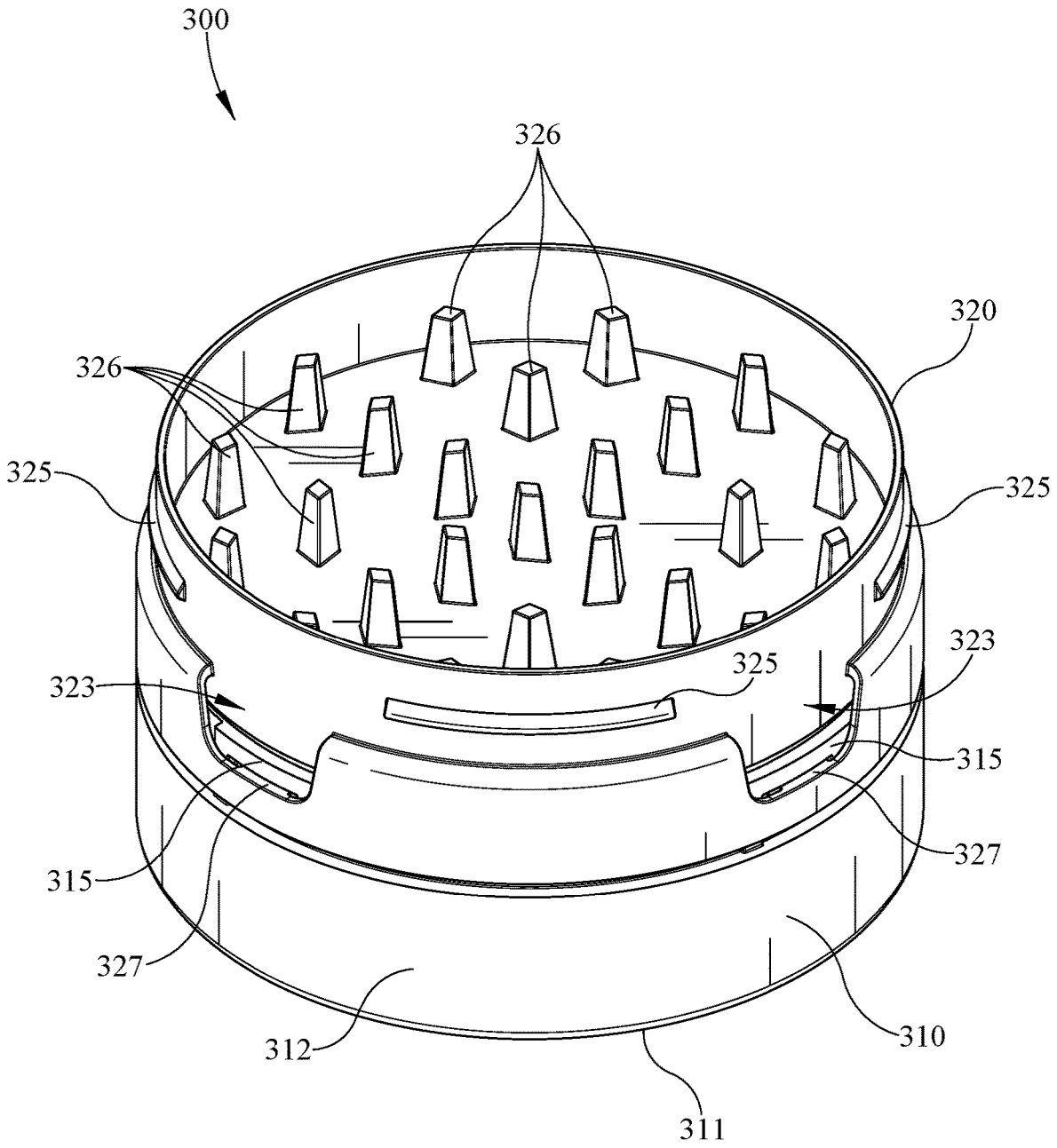
FIG. 3 illustrates another perspective view of the package of FIG. 1, with the lid removed to show an embodiment of a tray with an array of grinding pegs.

FIG. 3 shows package 300 with the lid removed to show tray 320 and lower grinders 326 in more detail. Lower grinders 326 may be sized, shaped, oriented, and/or configured for any of a variety of reasons including but not limited to grinding a substance into a smaller or finer form. Lower grinders 326 may operate in cooperation with lid 330 or any component thereof such as upper grinders 336 shown for example in FIG. 6. Lower grinders 326 and/or upper grinder 336 may be arranged in an array designed so that lid 330 may rotate relative to tray 320 and/or container 310, with upper grinders 336 rotating through the field of lower grinders 326 without substantial interference therefrom. In such a configuration, a user may place an item to be ground inside of tray 320 and could replace lid 330. The user may then rotate lid 330 relative to tray 320, causing the array of upper grinders 336 to pass through the interior of tray 320 passing lower grinders 326 in relatively close proximity causing grinding of the contents of tray 320.

Container 310 may include a feature to provide for coupling and/or attachment of tray 320 to container 310, such as one or more bayonets 315, as shown in FIG. 3. Tray 320 may include cooperating lugs 327 to engage bayonets 315 to cause a secure attachment of tray 320 to container 310. Bayonets 315 are shown in more detail in FIGS. 4 and 5. Referring again to FIG. 3, tray 320 may include a feature to facilitate attachment and/or coupling of tray 320 to lid 330. For example, tray 320 may include one or more beads 325, which may aid in a friction fit or snap fit of lid 330 onto tray 320, for example.

Figure 4:
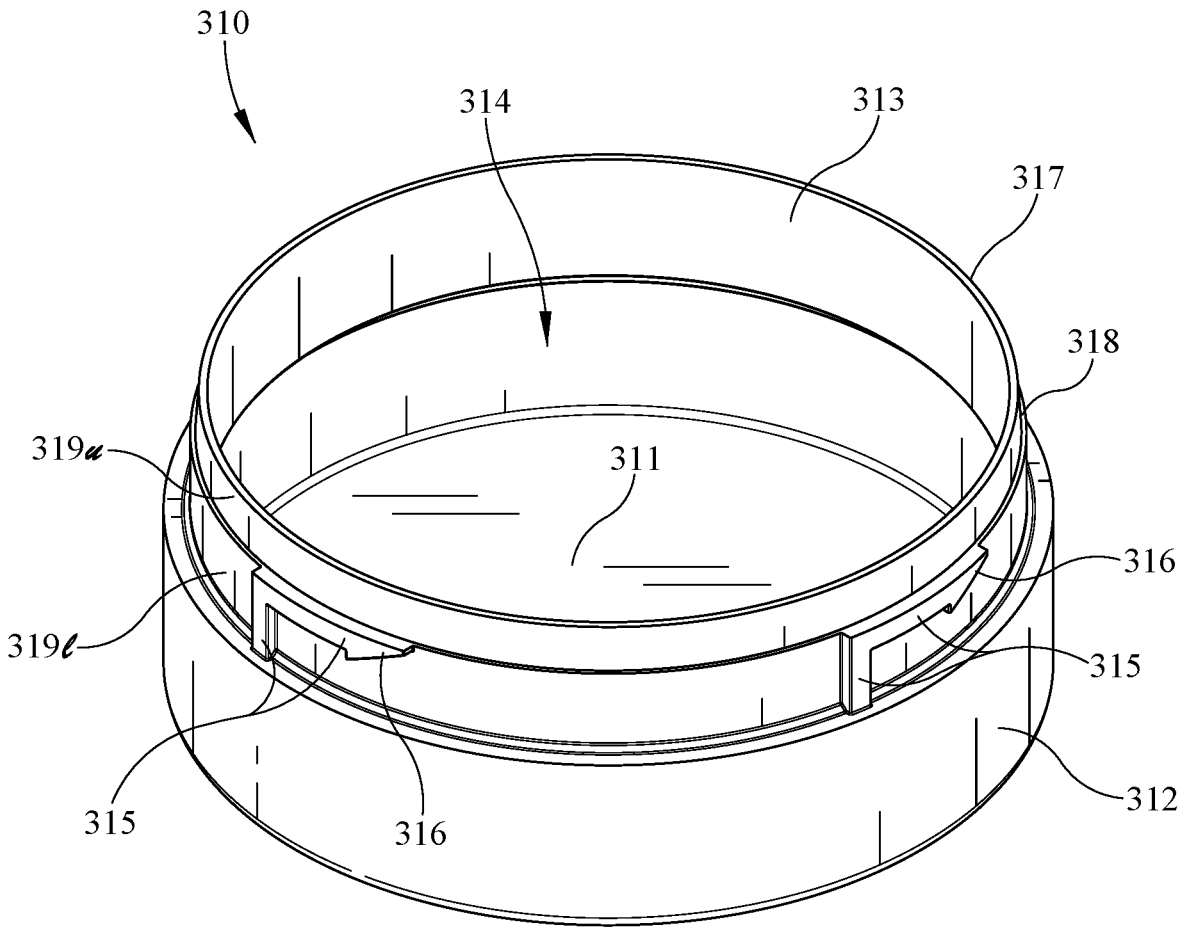
FIG. 4 illustrates an embodiment of a container that may be used with the package of FIGS. 1 and 2.
Figure 5:
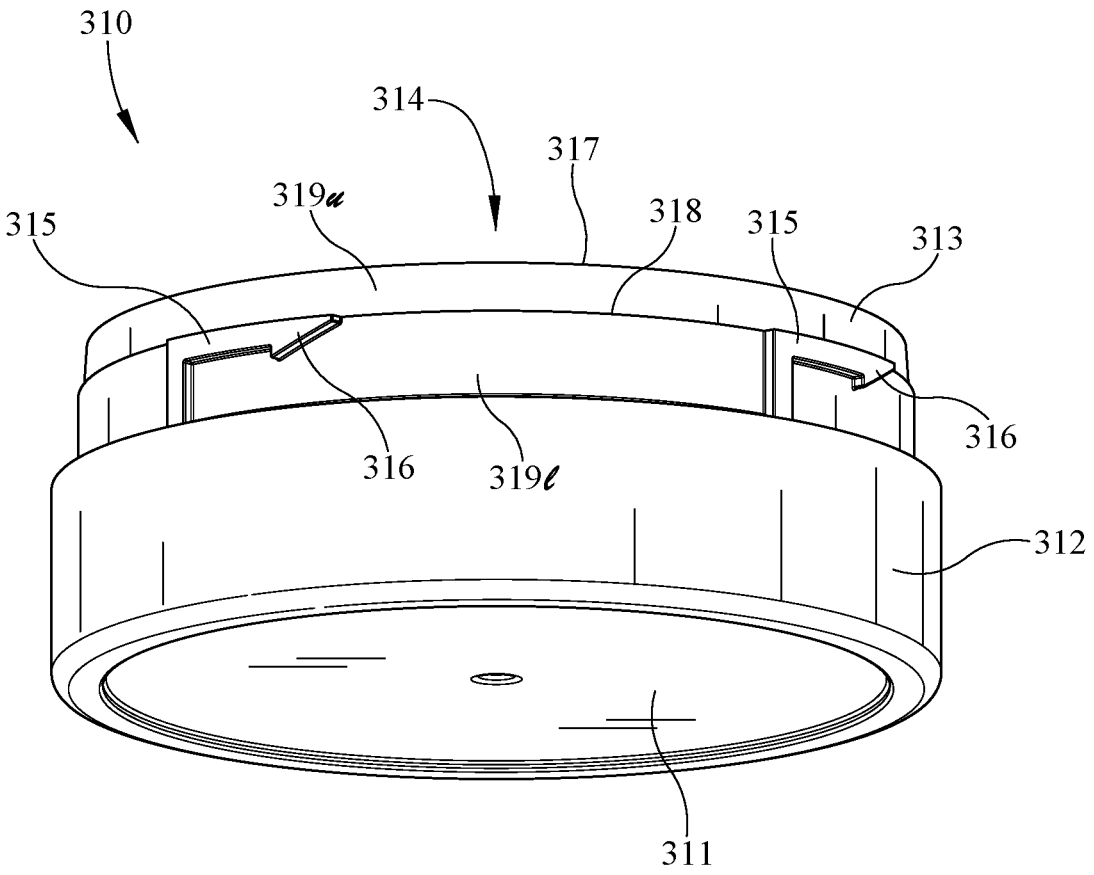
FIG. 5 illustrates another perspective view of the container of FIG. 4.

FIGS. 4 and 5 show container 310 with tray 320 and lid 330 removed. Container 310 may include a product storage region 314 substantially defined by container floor 311, container lower side wall 312, and/or container upper side wall 313. Bayonets 315 may include a tip 316 designed to form a secure attachment with tray 320, which may for example require a user to push down on lid 330 and/or tray 320 while rotating to disengage lugs 327 of tray 320 from bayonets 315 and/or tips 316. Lid 330 may include lugs or other structure to cooperate with bayonets 315 and/or tips 316 instead of or in addition to tray 320 including such features. Tray 320 may be biased upwardly relative to container 310, for example by a compressible disc and/or spring-like member at or near the underside of tray 320. For example, upper side wall 313 may include an angled feature at or near its top, which may cooperate and/or engage a rib or other structure on the underside of tray 320. The cooperation and/or interaction of such an angled feature with a rib or other surface configured in an angled relationship thereto may cooperate to form a wedge or similar mechanism forming a spring-like element. Such a biasing action could encourage lugs 327 of tray 320 to engage bayonets 315 and/or tips 316 to prevent rotation. A user could then apply downward force or any other force to overcome such a biasing element to disengage lugs 327 from bayonets 315, for example.

Figure 6:
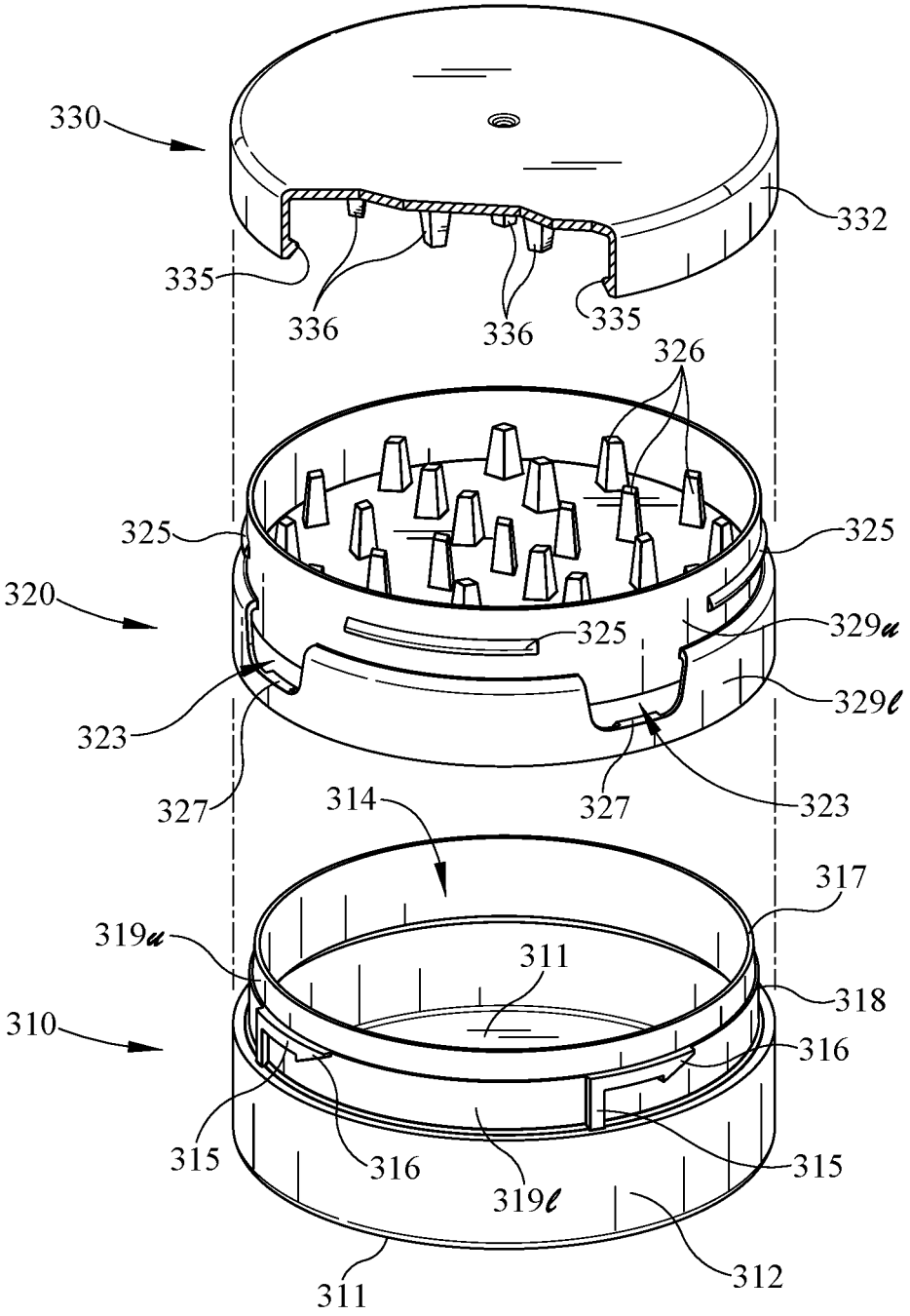
FIG. 6 illustrates an exploded assembly view of components of a package, including, from top to bottom, a lid, a tray, and a container.

An exploded assembly view of container 310, tray 320, and lid 330 is shown in FIG. 6. Tray 320 may be selectively attachable and/or removable from container 310, for example by use of bayonets 315 and lugs 327 as discussed in more detail above. Lid 330 may attach and/or couple to tray 320 in a way rendering it selectively removable and/or attachable. For example, lid 330 may include a bead that engages a bead of tray 320 to form a friction fit and/or a snap fit. It is understood that any of a variety of attachment and/or coupling mechanisms may be used to couple and/or attach any or all of container 310, tray 320, and lid 330 to any of the other of these components or any other component.

Container 310 may include an upper section of upper side wall 319*u*, which may be tapered from a smaller outer diameter or circumference at container top lip 317 to a relatively larger outer diameter or circumference at a bottom 318 of upper section of container upper side wall 319*u* adjacent where the upper section of container upper side wall 319*u* meets a lower section of container upper side wall 319*l*, as shown in FIG. 6. Tray 320 may include an upper tray side wall 329*u* and a lower tray side wall 329*l*. When tray 320 is in a closed position and/or attached to container 310, tray lower side wall 329*l* may be adjacent the lower portion of upper side wall 319*l* of container 310. In the closed or attached position, tray upper side wall 329*u* may be adjacent upper section of container upper side wall 319*u*.

Figure 8:
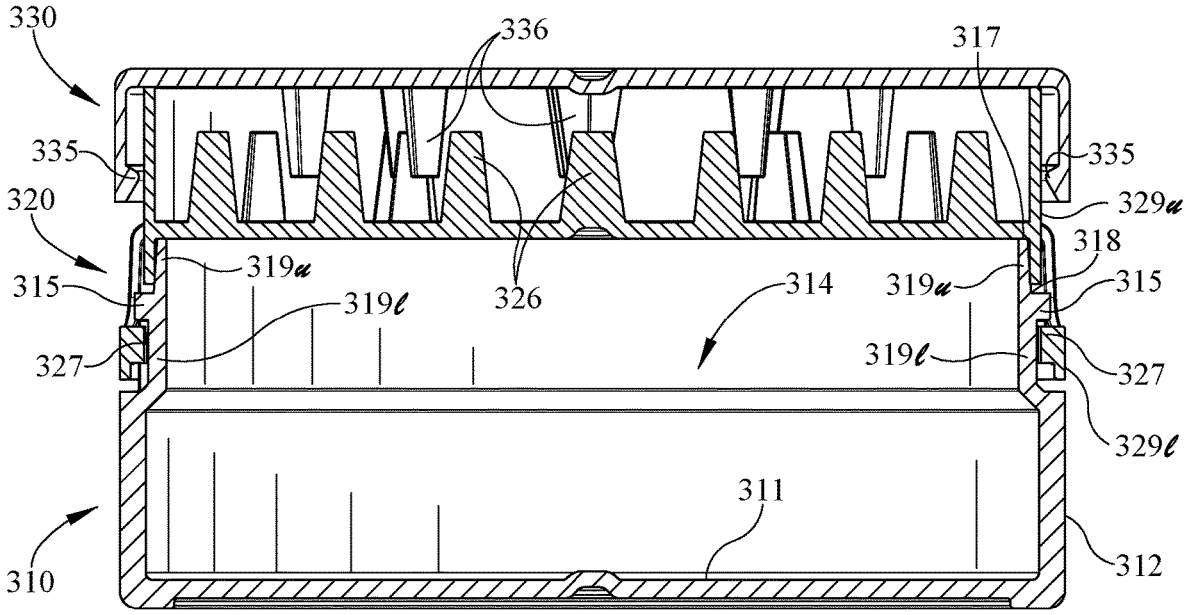
FIG. 8 illustrates a front cross section view of the package shown in FIG. 6.

The taper of upper portion 319*u* may interface with the inner surface of tray upper side wall 329*u*, as shown in additional detail in FIG. 8, biasing tray 320 upward relative to container 310 because of the spring like action created by the angled surface of upper portion 319*u* against the inner surface of tray lower portion 329*l*. Such upward biasing of tray 320 relative to container 310 may lock lugs 327 into bayonets 315 behind bayonet tip 316. A user selectively may provide an input such as a push or downward force to tray 320 (e.g., via pushing down on attached lid 330) to move, unlock, and/or release lug 327 from bayonet 315 so that lug 327 may be rotated past bayonet tip 316 and/or out of bayonet 315, for example, when a user provides a rotational movement or input. In this way, tray 320 may be released from container 310, or vice versa, with two user movements or inputs such as a pushing down input and a rotational input.

Lid 330 may be removably and/or selectively attachable to tray 320, for example, by interaction of a lid lip bead 335 and a tray lip bead 325, as shown, for example, in FIG. 8. Lid lip bead 335 may project radially inwardly from lid side wall 332 and tray lip bead 325 may project radially outwardly from an upper portion of tray side wall 329*u*. As lid 330 is pushed down onto tray 320, lid lip bead 335 may snap over and/or engage or attach to tray 320 via tray lip bead 325, for example, by a user lid attachment motion or input. An attachment mechanism of the sort created by interaction of lid lip bead 335 with tray lip bead 325 may be selectively overcome to remove lid 330 by a user grasping or prying lid 330 from tray 320, for example. Moreover, a user may engage slots 323 in tray 320 to facilitate removal of lid 330 from tray 320, for example, by inserting an object or a finger in slot 323 to lift lid 330 from tray 320. Moreover, the attachment mechanism created by lid lip bead 335 with tray lip bead 325 may retain lid 330 in a closed or attached position on tray 320 through separation or removal of tray 320 from container 310 (e.g., by the push and rotation described above to separate tray 320 from container 310). In this way, a user may remove or disengage tray 320 from container 310 without necessarily disengaging, removing, and/or separating lid 330 from tray 320, or vice versa.

Figure 7A:
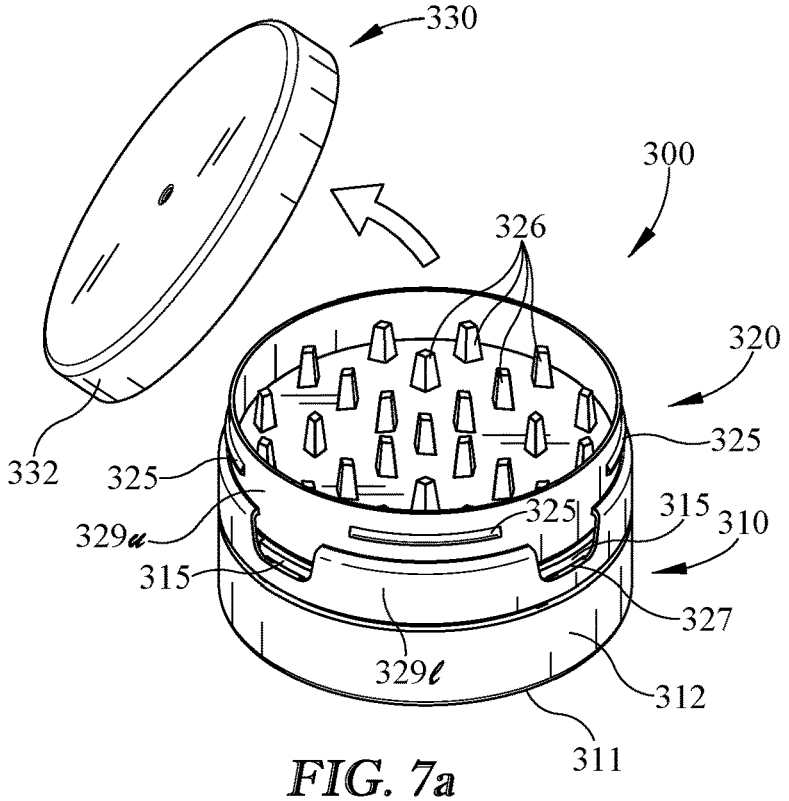
FIG. 7*a* illustrates a perspective view of an embodiment of a package with an arrow indicating removal of the lid.
Figure 7B:
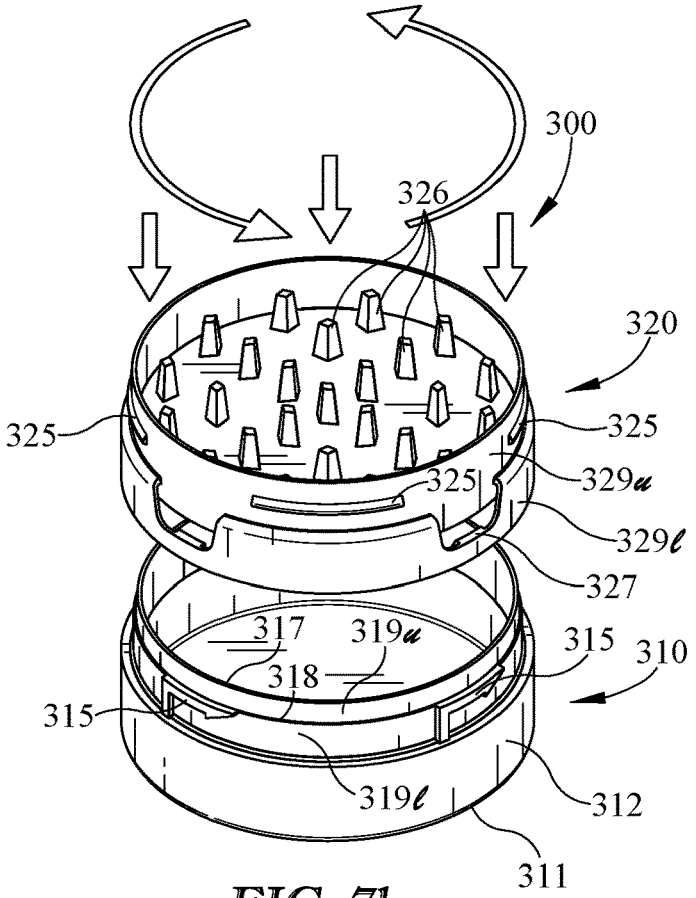
FIG. 7*b* illustrates a portion of an embodiment of the package of FIG. 7*a*, with the lid removed and the tray partially removed by being pushed down and rotated to allow the tray to be removed from the container and placed in a second open position.

FIGS. 7*a* and 7*b* illustrate how a user might use package 300 to access its contents and/or grind contents, for example. FIG. 7*a* shows an arrow indicating removal of lid 330 from tray 320. FIG. 7*b* shows downwardly pointing arrows indicating a downward force a user could use to disengage a locking mechanism (e.g., lugs and bayonets described above) as well as rotational arrows indicating rotation to disengage tray 320 from container 310 so that tray 320 may be removed therefrom, for example.

Figure 9:
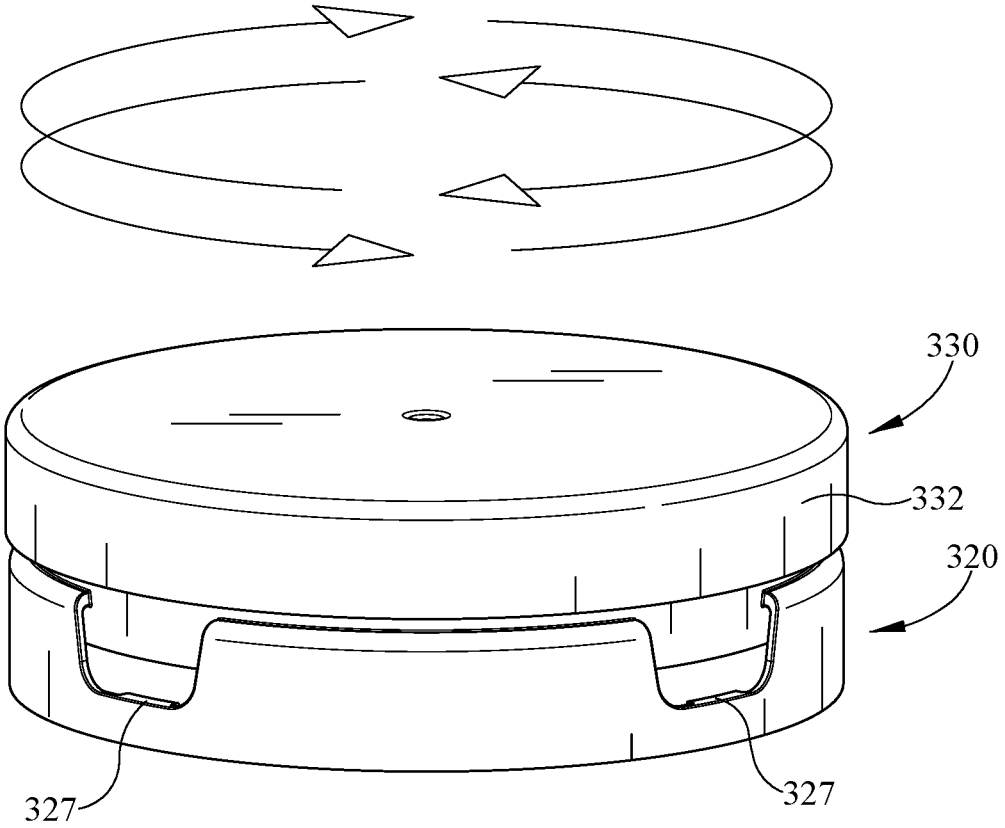
FIG. 9 illustrates a perspective view of an embodiment of a tray with a lid, with arrows indicating rotation of the lid relative to the tray to allow the array of grinders to grind an item or contents in the tray.

A grinding motion is indicated by the double arrows of FIG. 9. A user could place contents or items to be ground into tray 320 and cover it with lid 330. Either or both of tray 320 and lid 330 may have grinders, such as lower grinders 326 and/or upper grinders 336 described above, for example. A user could cause the rotational motion of lid 330 relative to tray 320 to cause grinding of the contents therein. In FIG. 9, tray 320 and lid 330 are shown without container 310. A user could grind contents in tray 320 while tray 320 is separate from container 310, and then transfer the contents to container 310, for example, if desired.

Figure 10:
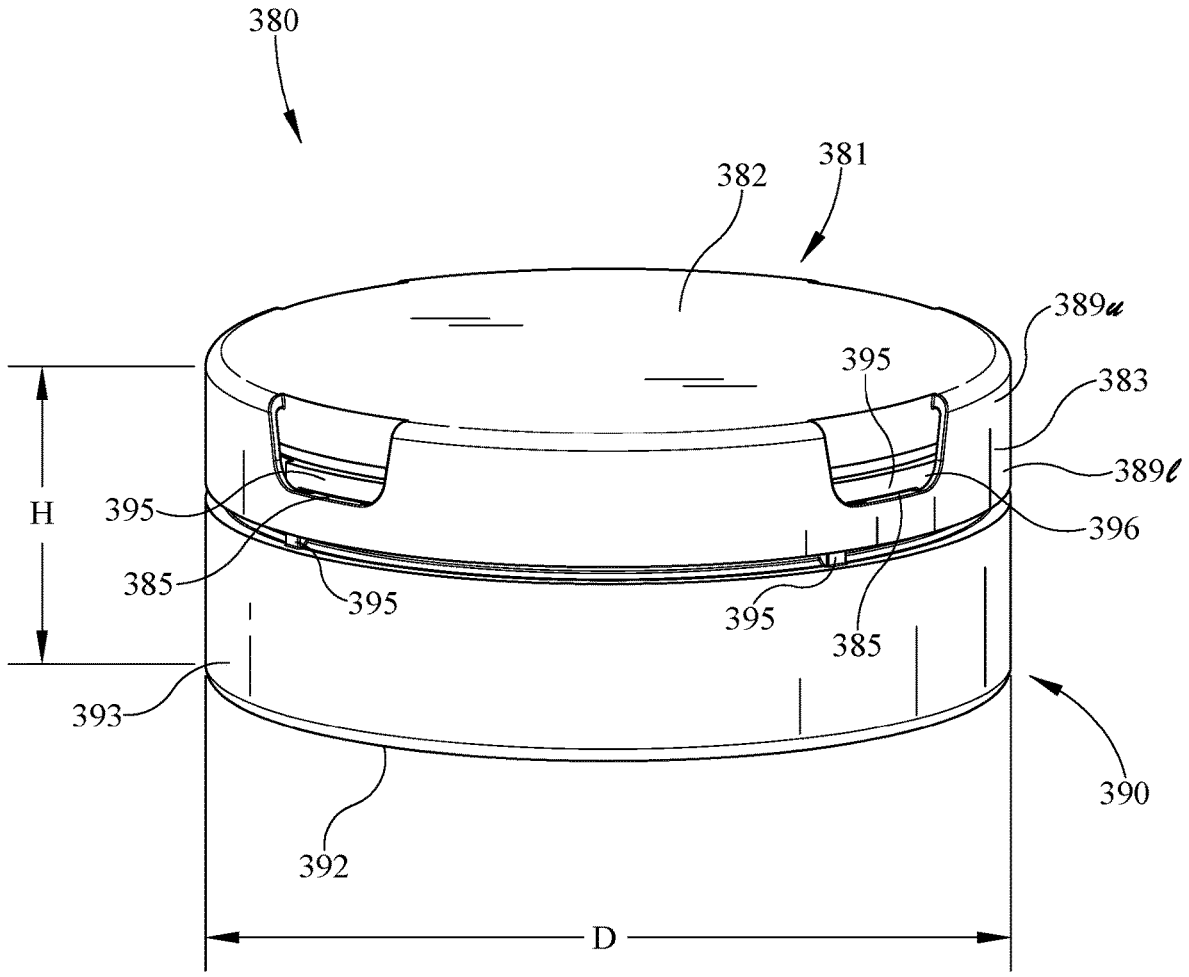
FIG. 10 illustrates another embodiment of a package with container and lid.

A relatively smaller or thinner version of package 380 is shown in FIG. 10 (smaller or thinner compared to package 300 shown for example in FIG. 1). In this embodiment of package 380, container 390 may define an internal container storage region therein, which may be underneath lid 381 when in the closed position. Lid 381 may attach and/or couple to container 290 substantially without a tray, such as tray 320 shown in FIG. 1. Lid 381 may be selectively and/or removably attached and/or coupled to container 390, for example, in a similar fashion as tray 320 may be selectively and/or removably attached and/or coupled to container 310 in the embodiment of package 300 shown in FIG. 1. Lid 381 may include a top 382 and/or a side wall 383, which may include a lug or similar structure 385 for attachment or coupling to container 390 for example via bayonet 395. Container 390 may include floor 392 and/or side wall 393 which may cooperate to at least partially define an interior container storage region. The coupling and/or attachment of lid 381 to tray 390 may be similar in some or all aspects as the coupling and/or attachment of tray 320 to container 310 described above in relation to package 300. Package 380, having no tray, may be thinner and/or have a lesser height than package 300, which may facilitate transport and/or storage of package 380, for example, in a user's trouser pocket. Package 380 may have a height H and/or an outer dimension such as diameter D related to its outer circumference or perimeter. As shown, lid 381 and container 390 may have a substantially similar outer diameter D or outer circumference or outer perimeter that is substantially similar, and package 380 may have a substantially uniform outer diameter D or outer circumference or outer perimeter as shown. Lid 381 and container 390, when attached and/or in a closed position, may have an overall height H, which may be substantially uniform across package 380, and/or may be substantially uniform, for example, at least around an outer circumference or perimeter. It is understood that package 380 could have a substantially uniform height H around the circumference or perimeter while having a variability height elsewhere, for example, at the center or a central portion of package 380.

Figure 11:
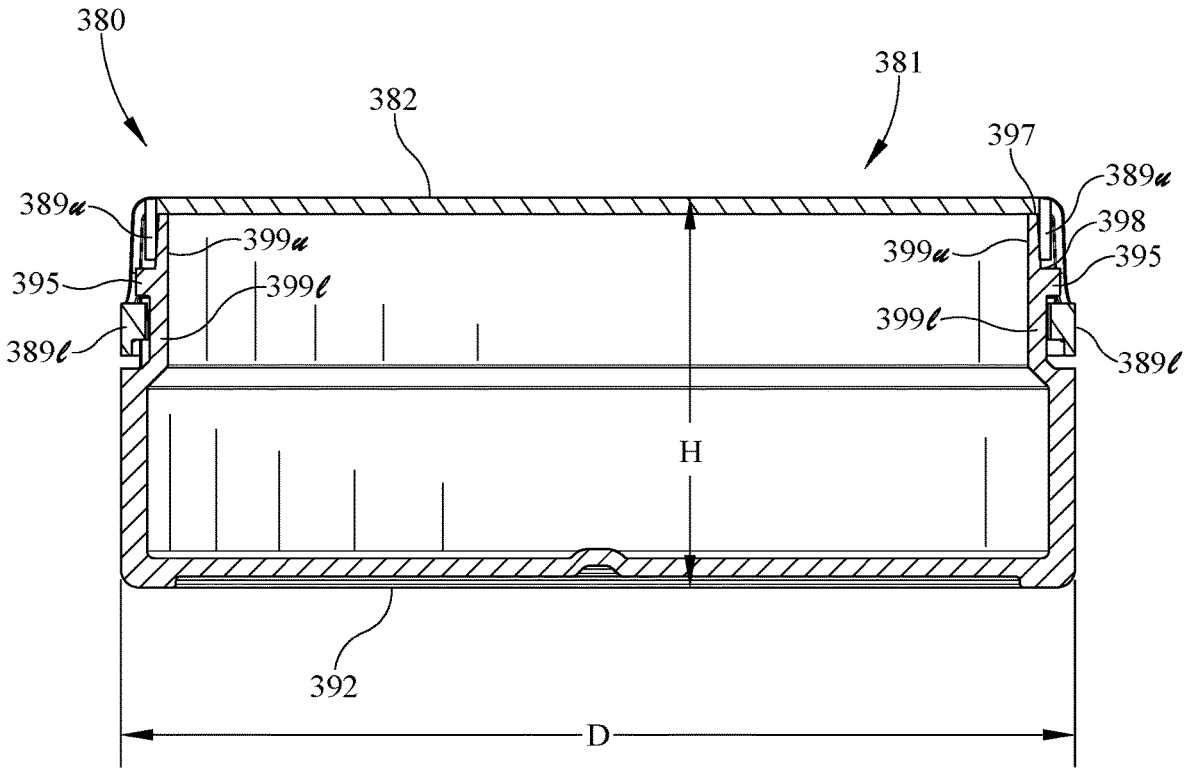
FIG. 11 illustrates a front cross section view of the package shown in FIG. 10.

As shown in FIG. 11, container 390 may include an upper section of upper side wall 399*u*, which may be tapered from a smaller outer diameter or circumference at container top lip 397 to a relatively larger outer diameter or circumference at a bottom 398 of upper section of container upper side wall 399*u* adjacent where the upper section of container upper side wall 399*u* meets a lower section of container upper side wall 399*l*. Lid 381 may include an upper lid side wall 389*u* and a lower lid side wall 389*l*. When lid 381 is in a closed position and/or attached to container 310, lid lower side wall 389*l* may be adjacent the lower portion of upper side wall 389*l* of container 390. In the closed or attached position, lid upper side wall 389*u* may be adjacent upper section of container upper side wall 399*u*. The taper of upper portion 399*u* may interface with the inner surface of lid upper side wall 389*u*, biasing lid 381 upward relative to container 390 because of the spring like action created by the angled surface of upper portion 399*u* against the inner surface of lid lower portion 389*l*. Such upward biasing of lid 381 relative to container 390 may lock lugs 385 into bayonets 395 behind bayonet tip 396. A user selectively may provide an input such as a push or downward force to lid 381 to move, unlock, and/or release lug 385 from bayonet 395 so that lug 385 may be rotated past bayonet tip 396 and/or out of bayonet 395, for example, when a user provides a rotational movement or input. In this way, lid 381 may be released from container 390, or vice versa, with two user movements or inputs such as a pushing down input and a rotational input.

It is understood that package 300 or 380, container 310 or 390, tray 320, and/or lid 330 or 381, and/or any component thereof, may be made of any of a variety of materials, including, but not limited to, any of a variety of suitable plastics material, any other material, or any combination thereof. Suitable plastics material may include, but is not limited to, polypropylene (PP), polyethylene (PE), polyethylene terephthalate (PET), polystyrene (PS), high-density polyethylene (HDPE), low-density polyethylene (LDPE), linear low-density polyethylene (LLDPE), crystallized polyethylene terephthalate (CPET), mixtures and combinations thereof, or any other plastics material or any mixtures and combinations thereof. It is understood that multiple layers of material may be used for any of a variety of reasons, including to improve barrier properties, or to provide known functions related to multiple layer structures. The multiple layers, if included, may be of various materials, including but not limited to those recited herein.

It is further understood that package 300 or 380, container 310 or 390, tray 320, and/or lid 330 or 381, and/or any component thereof, may be substantially rigid, substantially flexible, a hybrid of rigid and flexible, or any combination of rigid, flexible, and/or hybrid, such as having some areas be flexible and some rigid. It is understood that these examples are merely illustrative, are not limiting, and are provided to illustrate the versatility of options available in various embodiments of package 300 or 380, container 310 or 390, tray 320, and/or lid 330 or 381, and/or any component thereof.

It is further understood that any of a variety of processes or combination thereof may be used to form package 300 or 380, container 310 or 390, tray 320, and/or lid 330 or 381, and/or any component thereof, or any layer or substrate used therein. For example, any component, layer, or substrate, or combination thereof, may be thermoformed, injection molded, injection stretch blow molded, blow molded, extrusion blow molded, coextruded, subjected to any other suitable process, or subjected to any combination thereof. In some embodiments, package 300 or 380, container 310 or 390, tray 320, and/or lid 330 or 381, and/or any component thereof may be formed substantially of injection molded and/or thermoformed suitable plastics material, although other materials and forming processes may be used instead of or in addition to injection molding and thermoforming, respectively. Various materials and/or processes may be used to form package 300 or 380, container 310 or 390, tray 320, and/or lid 330 or 381, and/or any component thereof, as will be understood by one of ordinary skill in the art. In some embodiments, container 310 or 390, tray 320, and/or lid 330 or 381, and/or any component thereof, may be substantially a one-piece design and/or substantially formed as an integral or unitary structure.

It is understood that, while some directional terms are used herein, such as top, bottom, upper, lower, inward, outward, upward, downward, etc., these terms are not intended to be limiting but rather to relate to one or more exemplary orientations, positions, and/or configurations of package 300 or 380, container 310 or 390, tray 320, and/or lid 330 or 381, and/or any component thereof. It is understood that package 300 or 380, container 310 or 390, tray 320, and/or lid 330 or 381, and/or any component of package 300 or 380, may be oriented differently than shown in the various figures.

These and other modifications and variations may be practiced by those of ordinary skill in the art without departing from the spirit and scope, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the scope of that which is described in the claims. Therefore, the spirit and scope of the appended claims should not be limited to the exemplary description of the versions contained herein.

That which is claimed:

1. A package, comprising:

a container, a tray, and a lid, wherein the tray is removably attachable to the container to define a first product storage region and the lid is removably attachable to the tray to form a second product storage region;

wherein the tray is movable by a user input between an open container position in which the tray is at least partially removed from the container and a closed container position in which the tray is blocking access to the first product storage region;

wherein the tray is lockably attachable to the container in a locked position to prevent rotation of the tray relative to the container in at least one rotational direction, and wherein the tray is selectively movable by a user input in an axial direction transverse to the at least one rotation direction between the locked position and a released position;

wherein the tray is free to rotate in the at least one rotational direction in the released position; and wherein the lid is movable relative to the tray between a closed lid position in which the lid substantially blocks access to the second product storage region and an open lid position in which the second product storage region is accessible by a user.

2. The package of claim 1, wherein the tray is lockably attachable to the container by one or more closure mechanisms that each include a tray projection and a cooperating container projection.

3. The package of claim 2, wherein at least one of the one or more closure mechanisms includes a bayonet and a cooperating lug.

4. The package of claim 3, wherein the bayonet is coupled to the container.

5. The package of claim 3, wherein the cooperating lug is coupled to the tray.

6. The package of claim 3, wherein the bayonet includes a leading tip having an angled surface oppositely disposed a blunt surface, wherein the angled surface allows rotation of the cooperating lug into the bayonet and the blunt surface inhibits rotation of the cooperating lug out of the bayonet in the locked position.

7. The package of claim 6, wherein the container includes an upper side wall that forms an angled interface with a lower side wall of the tray, and wherein the angled interface biases the tray away from the container in a first direction.

8. The package of claim 7, wherein the bias of the angled interface of the container upper side wall and the tray lower side wall may be overcome by a user push input, wherein the user push input may move the tray lower side wall relative to the container upper side wall from the locked position to the released position in which the cooperating lug may be rotated out of the bayonet.

9. The package of claim 3, wherein the cooperating lug in the container is formed adjacent a slot in the tray.

10. The package of claim 2, wherein the one or more closure mechanisms includes at least three closure mechanisms.

11. The package of claim 10, wherein the at least three closure mechanisms each include a bayonet and a cooperating lug.

12. A package, comprising:

a container, a tray, and a lid, wherein the tray is removably attachable to the container to define a first product storage region and the lid is removably attachable to the tray to form a second product storage region;

wherein the tray is movable by a user input between an open container position in which the tray is at least partially removed from the container and a closed container position in which the tray is blocking access to the first product storage region;

wherein the tray is lockably attachable to the container in a locked position to prevent rotation of the tray relative to the container in at least one rotational direction, and wherein the tray is selectively movable by a user input in an axial direction transverse to the at least one rotation direction between the locked position and a released position;

wherein the tray is free to rotate in the at least one rotational direction in the released position;

wherein the lid is movable relative to the tray between a closed lid position in which the lid substantially blocks access to the second product storage region and an open lid position in which the second product storage region is accessible by a user; and wherein the lid includes a plurality of downwardly projecting upper grinders and the tray includes a plurality of upwardly projecting lower grinders, wherein the upper grinders and lower grinders are arranged to pass without contact when the lid is rotated relative to the tray when the lid and tray are in the closed lid position.

13. The package of claim 12, wherein the lid includes a radially inwardly projecting bead configured to selectively removably attach to a corresponding radially outwardly projecting bead on a tray upper side wall.

14. The package of claim 12, wherein the lid and tray are configured to be removable by a user lid removal input, wherein the tray and container are configured to be removable by a user container removal input, and wherein the lid and tray are configured to remain attached through the user container removal input.

15. The package of claim 14, wherein the container removal input includes a rotational movement of the tray relative to the container in a rotational direction and an axial movement of the tray relative to the container in a first axial direction transverse to the rotational direction.

16. The package of claim 15, wherein the user lid removal input includes a movement of the lid relative to the tray in a second axial direction opposite the first axial direction.

17. A package, comprising:

a container and a lid, wherein the lid is removably attachable to the container to form a product storage region;

wherein the lid is movable by a user input between an open container position in which the lid is at least partially removed from the container and a closed container position in which the lid is blocking access to the product storage region;

wherein the lid is lockably attachable to the container in a locked position to prevent rotation of the lid relative to the container in at least one rotational direction, and wherein the lid is selectively movable by a user input in an axial direction transverse to the at least one rotation direction between the locked position and a released position;

wherein the lid is free to rotate in the at least one rotational direction in the released position;

wherein the lid and container have a substantially uniform and equal outer perimeter and a substantially uniform height around the outer perimeter circumference;

wherein the lid is lockably attachable to the container by one or more closure mechanisms that each include a lid projection and a cooperating container projection;

wherein a bayonet is coupled to the container;

wherein a cooperating lug is coupled to the lid;

wherein the bayonet includes a leading tip having an angled surface oppositely disposed a blunt surface, wherein the angled surface allows rotation of the cooperating lug into the bayonet and the blunt surface inhibits rotation of the cooperating lug out of the bayonet in the locked position;

wherein the container includes an upper side wall that forms an angled interface with a lower side wall of the lid, and wherein the angled interface biases the lid away from the container in a first direction;

wherein the bias of the angled interface of the container upper side wall and the lid lower side wall may be overcome by a user push input, wherein the user push input may move the lid lower side wall relative to the container upper side wall from the locked position to the released position in which the cooperating lug may be rotated out of the bayonet;

wherein the lid includes a plurality of downwardly projecting upper grinders and the container includes a plurality of upwardly projecting lower grinders, wherein the upper grinders and lower grinders are arranged to pass without contact when the lid is rotated relative to the container when the lid and tray are in the closed container position.

* * * * *